United States Patent [19]

Koiso et al.

[11] Patent Number: 5,020,697

[45] Date of Patent: Jun. 4, 1991

[54] IMAGE RECORDING APPARATUS HAVING TONER RESERVOIR

[75] Inventors: Jun-ichi Koiso; Atsuo Ohmura, both of Hachioji, Japan

[73] Assignee: Konica Corporation, Tokyo, Japan

[21] Appl. No.: 369,477

[22] Filed: Jun. 21, 1989

[30] Foreign Application Priority Data

Jun. 24, 1988 [JP] Japan ..... 63-157725
Mar. 17, 1989 [JP] Japan ..... 1-65034

[51] Int. Cl.[5] ..... G03G 15/00

[52] U.S. Cl. ..... 222/325; 222/108; 222/129; 222/167; 222/318; 222/DIG. 1; 355/298

[58] Field of Search ..... 222/129, 148, 318, 108–111, 222/325, DIG. 1, 167; 355/298; 141/364, 311 R

[56] References Cited

U.S. PATENT DOCUMENTS 4,218,126 8/1980 Takeichi ..... 355/298
4,501,484 2/1985 Shimura ..... 355/298 X
4,625,895 12/1986 Tsukano ..... 222/DIG. 1 X
4,696,418 9/1987 Kurotaka et al. ..... 222/DIG. 1 X
4,732,277 3/1988 Smith ..... 222/DIG. 1 X
4,826,226 8/1989 Imaizumi et al. ..... 222/DIG. 1 X

FOREIGN PATENT DOCUMENTS 0093480 5/1986 Japan ..... 355/298

*Primary Examiner*—Kevin P. Shaver
*Attorney, Agent, or Firm*—Jordan B. Bierman

[57] ABSTRACT

An image recording apparatus having a toner reservoir. The toner reservoir is removably mounted on the process cartridge or a developing device in the image recording apparatus. The toner reservoir is composed of a supply toner reserving unit having a supply opening and a recovery toner container having a waste toner recovery opening. The supply toner reserving unit and said recovery toner reserving unit are connected with each other through a connecting member, the supply toner reserving unit being arranged rotatably while the recovery toner reserving unit being fixed with the recovery opening thereof facing upward.

9 Claims, 9 Drawing Sheets

IMAGE RECORDING APPARATUS HAVING TONER RESERVOIR

BACKGROUND OF THE INVENTION

1. Field of the Invention

The present invention relates to a toner reservoir removably mounted in a developing device for visualizing an electrostatic latent image, which is formed on an image retainer, with a powdery developer by the electrophotographic or electrostatic recording method.

2. Description of the Prior Art

In an electrophotographic copying machine or electrostatic recording apparatus such as an image recording apparatus making use of an electrostatic image, generally speaking, an objective record is obtained by forming an electrostatic image on an electrostatic image retainer, by applying toner to the electrostatic image to visualize it by a developing device, and by transferring and fixing the toner image obtained to and on recording paper. After the image has been transferred from the electro-static image retainer its residual charges are erased by an electric elimination electrode and then its residual toner is removed by a cleaning device.

In the developing device described above, a toner in a toner supply unit supplied by a toner supply container is supplied in a necessary amount to a developer agitating unit. When the toner in its supply unit is reduced by repeating the supply from the toner supply unit, a toner supply indication lamp, for example, is lit, and the toner supply container is replaced to supply the toner.

On the other hand, the toner removed by the cleaning device is recovered by a toner recovery container disposed in the vicinity of the cleaning device.

In the prior art, the toner supply container and the toner recovery container are separately provided.

When the residual toner caught by the surface of the electrostatic image retainer is to be removed by the cleaning device so that the removed toner may be recovered in the recovery container, the timing of replacing the recovery container is of a major concern. This recovery container is usually not equipped with means for detecting and indicating the amount of recovery so that the recovery state has to be examined by removing said container.

About 70% of the toner supplied is consumed while the remaining 30% is removed by the cleaning device and recovered by the recovery container. If the replacement of the toner recovery container is neglected, the recovered toner will overflow the container to contaminate the surroundings. In order to prevent this, there has been disclosed Japanese Patent Laid-Open No. 58 - 173783 or Japanese Utility Model Publication No. 61 - 37008, for example, in which any special container is not prepared for the toner removed but the toner supply container is mounted on the cleaning device after the supply to accomplish the toner recovery.

As a united structure for the toner supply and recovery containers, on the other hand, there has been disclosed Japanese Patent Laid-Open No. 59 - 184373, for example, in which one toner container is equipped therein with a partition to form reservoirs for the toner before use and after recovery. With such positions of openings of the toner supply and the waste toner recovery, as disclosed in the embodiment, however, it is necessary to provide carry-in and carry-out means for releasing the toner from the toner container and for recovering it into the toner container. Another problem inclusive is the shielding performance between the partition and the container body. Thus, the united structure is short of reality.

SUMMARY OF THE INVENTION

The present invention has been conceived to solve the problems described above. An object of the present invention is to provide an image recording apparatus having a toner reservoir which has a simple structure but permits a reliable replacement of its toner recovery container upon each replacement of a toner supply container.

The above-specified object is achieved by a toner reservoir removably mounted on a developing device, which reservoir is characterized by uniting a supply toner container having a supply opening through which supply toner is released by its own weight and a recovery toner container having a waste toner recovery opening.

Other objects and features of the present invention will be described with reference to the accompanying drawings.

DESCRIPTION OF THE PREFERRED EMBODIMENT

Figure 4:
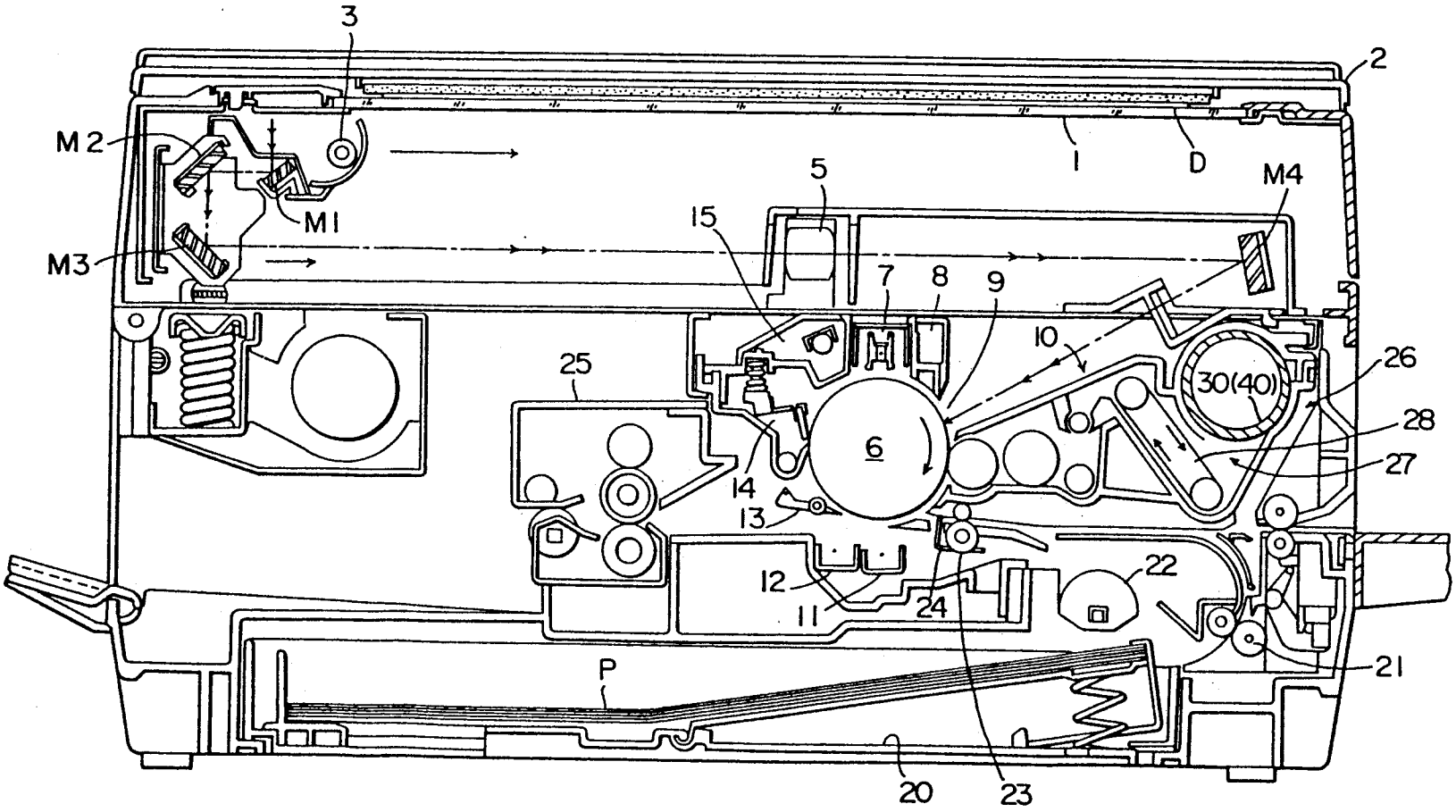
FIG. 4 is a section of a copying machine equipped with the toner reservoir of the present invention.

FIG. 4 is a section of a copying machine equipped with a toner reservoir according to the present invention. A process for forming a copy image will be summarized with reference to FIG. 4.

An image retainer 6 is prepared by evaporating or applying a photoconductive photosensitive layer on or to an electrically conductive support cylinder. Indicated at reference numeral 7 is a charging electrode which is arranged above and close to the image retainer 6. The charging electrode 7 accomplishes the corona discharge for charging the image retainer 6 sequentially with the rotations of the image retainer 6. Upstream and downstream of the charging electrode 7, respectively, there are arranged a pre-exposure lamp 15 and an erasure LED 8 for adjusting the surface potential of the image retainer 6.

After this adjustment, the image retainer 6 is subjected to an exposure at an exposure position 9. An electrostatic latent image is obtained by illuminating a document D on a document glass plate 1, which is disposed on the top surface of the copying machine, with an exposure lamp 3 movably supported in the vicinity of the document glass plate 1, and by illuminating and focusing an image of the document D on the image retainer 6 at the exposure position 9 via reflecting mirrors M1, M2 and M3, a lens 5 and a reflecting mirror M4. Designated at numeral 2 is an openable document cover for holding the document D.

The image retainer 6 retaining the electrostatic latent image corresponding to the document image is developed by a developing device 10. The toner density of the developer in the developing device 10 is maintained at a constant level by the toner which is supplied via a toner supply unit 26 having a toner reservoir 30 according to the present invention. The image retainer 6 retaining the visible image arrives at a transfer unit to transfer its toner image to transfer paper P that has been fed. This transfer paper P is fed out from a paper feed cassette 20 by a first paper feed roller 22 and is guided through an arranging unit 21 by a guide plate until it reaches a third paper feed roller 23. Here, the transfer paper P is synchronously fed to the toner image, which has been visualized on the image retainer 6, by the cooperations of the third paper feed roller 23 and a resist shutter 24.

The transfer paper P thus fed to the transfer unit comes into close contact with the surface of the image retainer 6 and it is subjected from its back to the corona discharge of the polarity reverse to that of the toner by a transfer electrode 11 so that the toner image is transferred thereto.

The transfer paper P onto which the toner image has been transferred is separated from the image retainer 6 by a separating electrode 12 and a separation pawl 13 and arrives at a fixing unit 25 where it is thermally fixed by a heating roller and discharged by a discharge roller.

Meanwhile, the image retainer 6 having separated from the transfer paper P is restored to its original state by removing the residual toner on its surface by a cleaning device 14.

From then on, the image forming operations are repeated by actions similar to the aforementioned ones.

Figure 1:
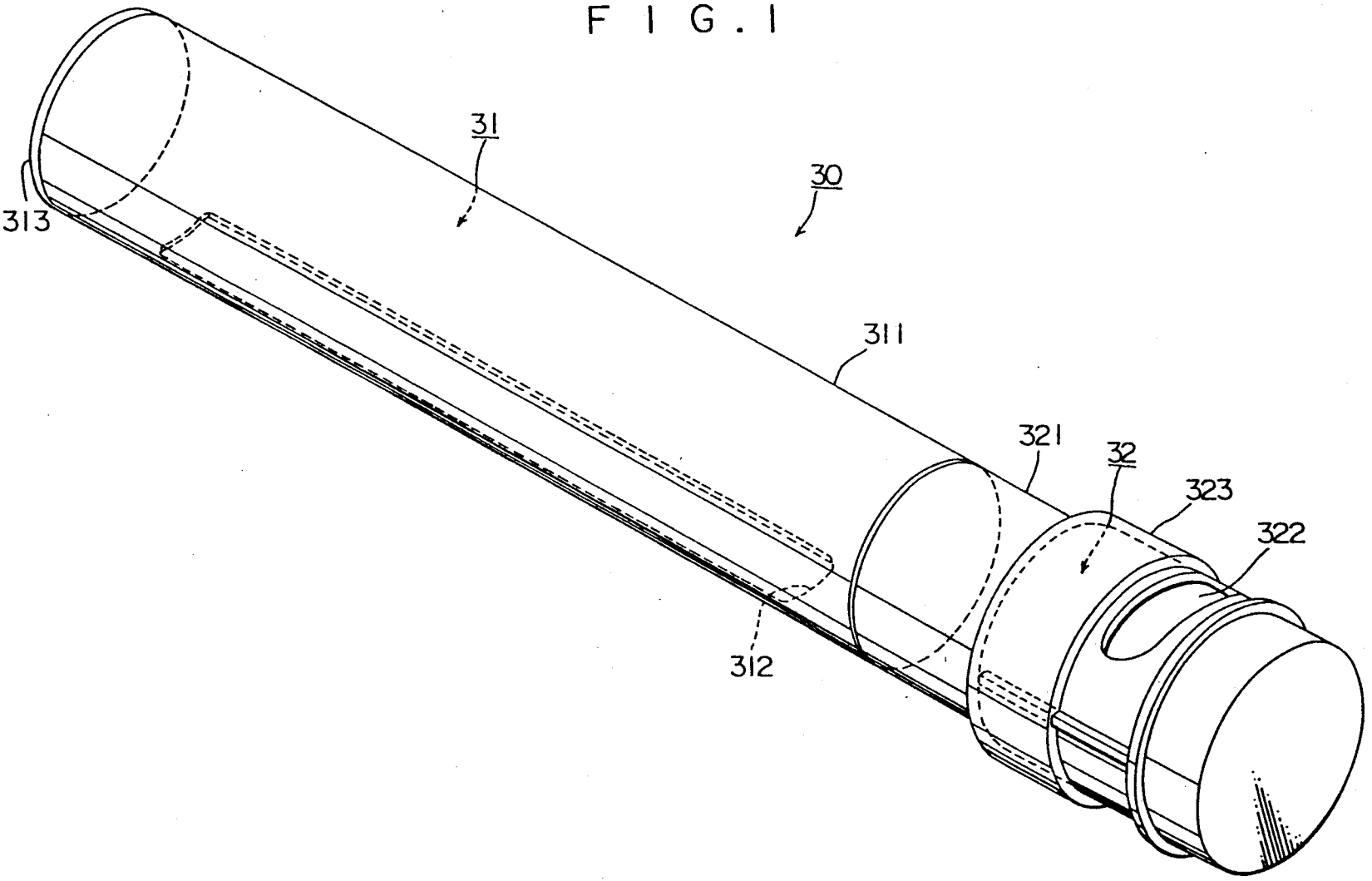
FIG. 1 is a perspective view showing a toner reservoir according to the prior art
Figure 2:
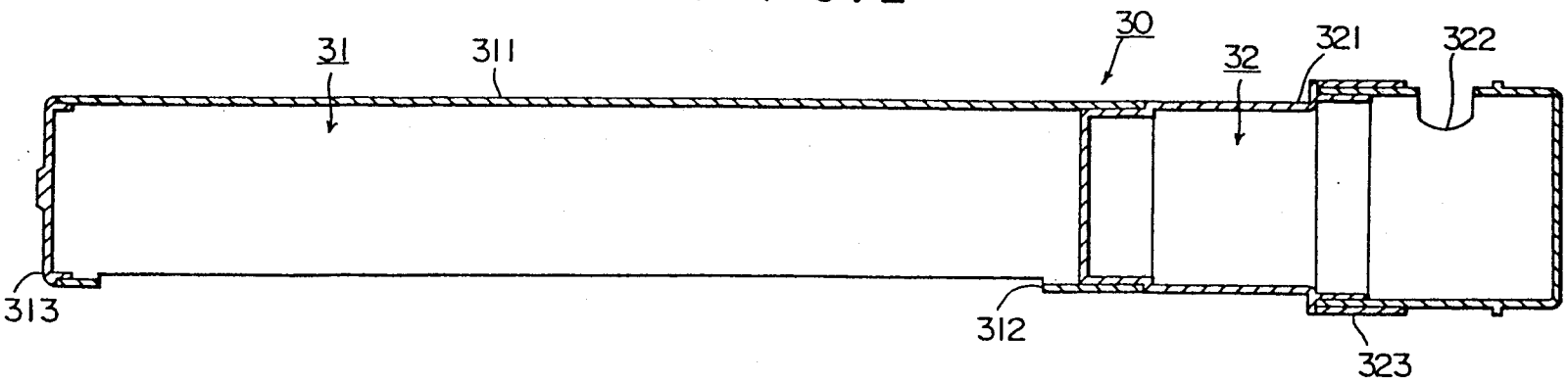
FIG. 2 is a section showing the prior art toner reservoir.
Figure 3:
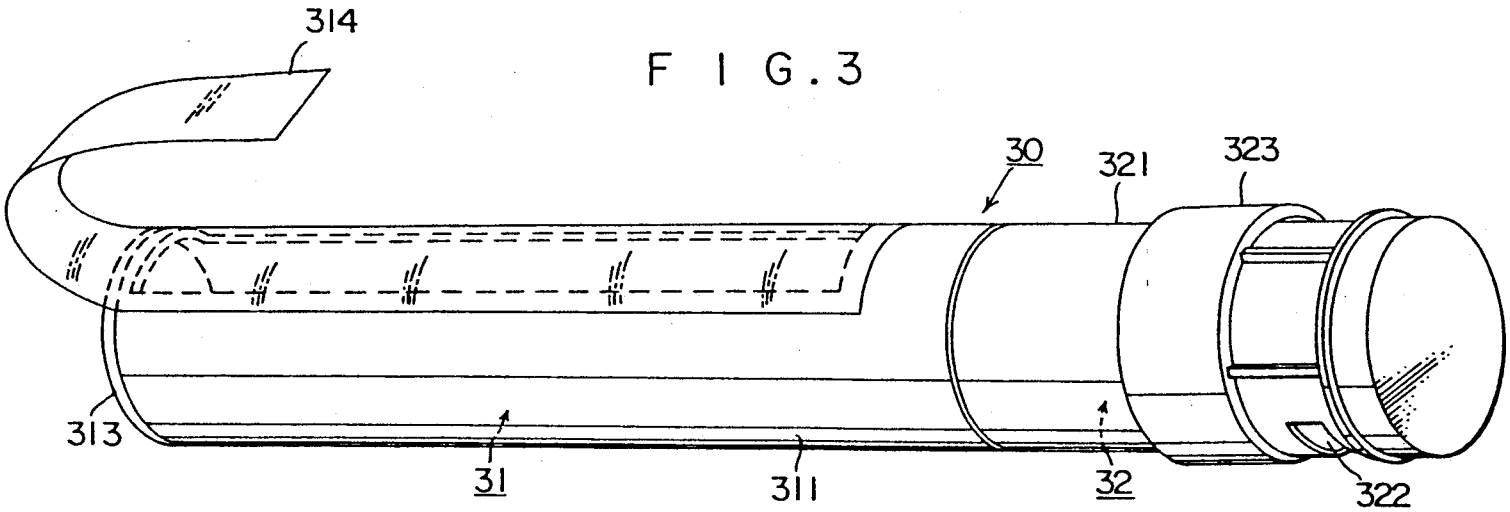
FIG. 3 is a perspective view showing the prior art toner reservoir with its supply opening directed upward.

FIG. 1 is a perspective view showing the toner reservoir 30 of the present invention; FIG. 2 is a section showing the same; and FIG. 3 is a perspective view showing the state in which the toner supply opening is directed upward.

In these Figures, reference numeral 31 designates a supply toner reserving unit for reserving the toner before use. Designated at numeral 32 is a recovery toner reserving unit for reserving the toner recovered from the cleaning device 14. The toner reservoir 30 is constructed of the supply toner reserving unit 31 and the recovery toner reserving unit 32.

The supply toner reserving unit 31 is composed of: a drum member 311 having a hollow cylinder shape and provided with a supply opening 312 cut long in the longitudinal direction of the cylinder side wall; a cap member 313 adhered to seal the backward (or leftward) terminal opening of the drum member 311; and a peelable, flexible seal member 314 sealing the aforementioned supply opening 312.

The recovery toner reserving unit 32 is composed of: a reservoir member 321 having an end-closed hollow cylinder shape and provided with a recovery opening 322 cut long in the circumferential direction of the cylinder side wall; and a shutter member 323 made slidable in the longitudinal direction of the aforementioned reservoir member 321 for opening or closing the recovery opening 322.

Figure 5:
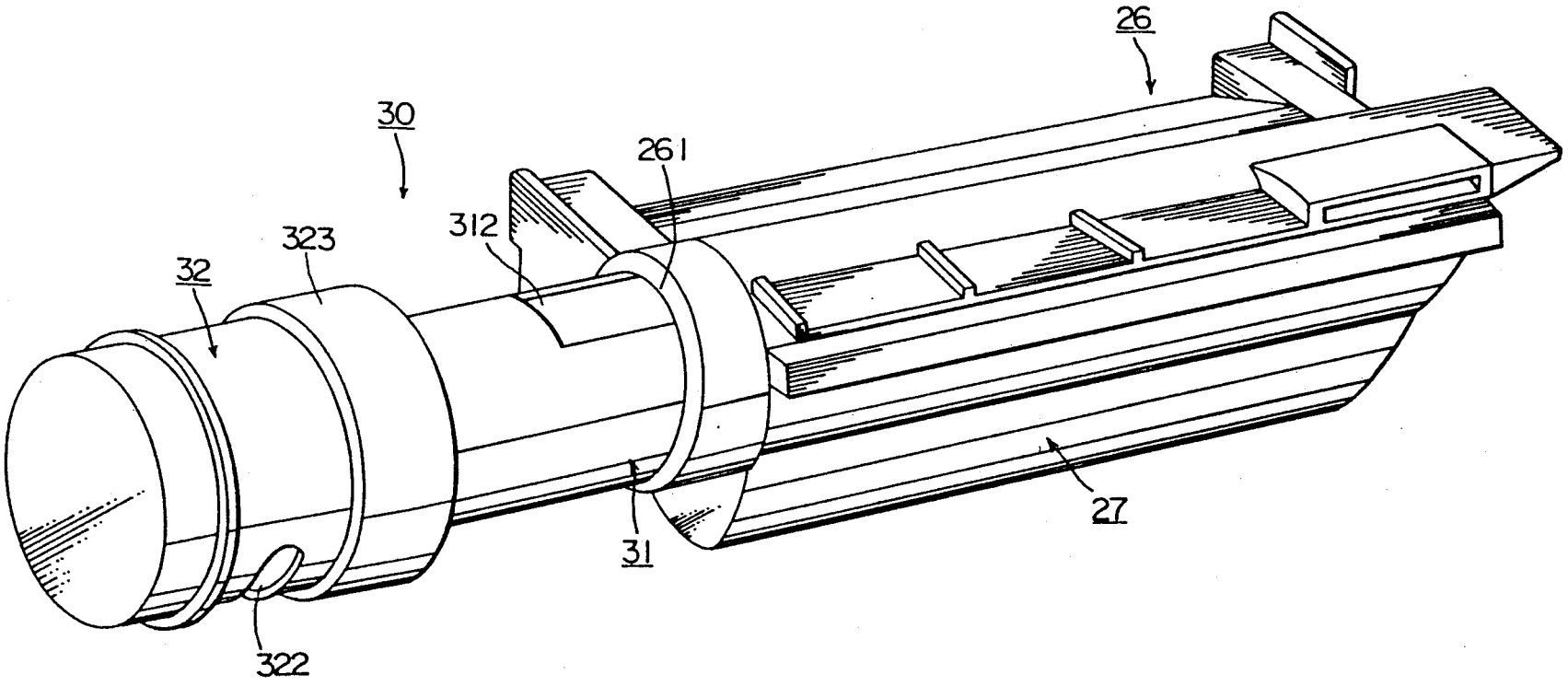
FIG. 5 is a perspective view showing a process for charging a toner supply unit of a developing device with the toner reservoir.

FIG. 5 is a perspective view showing a toner supply unit 26 and the toner reservoir 30 during the procedure for mounting the toner reservoir 30. The toner reservoir 30 is gripped with its recovery toner reserving portion 32 at the operator's side and its supply opening 312 above and is inserted with its cap member 313 at the other side into on entrance opening 261 of the toner supply unit 26 until its leading end is fitted. Next, the flexible seal member 314 shown in FIG. 3 is peeled off by pulling its leading end, and the supply opening 312 of the drum member 311 is opened to its fully open state, followed by further pushing of the toner reservoir 30.

If the terminal portion of the recovery toner reserving unit 32 is manually turned by 180 degrees, the supply opening 312 is turned to the bottom so that the toner in the supply toner reserving unit drops by its own weight into the toner hopper 27 and is reserved therein. At the same time, the recovery opening 322 is directed upward to admit the recovery toner.

Figure 6A:
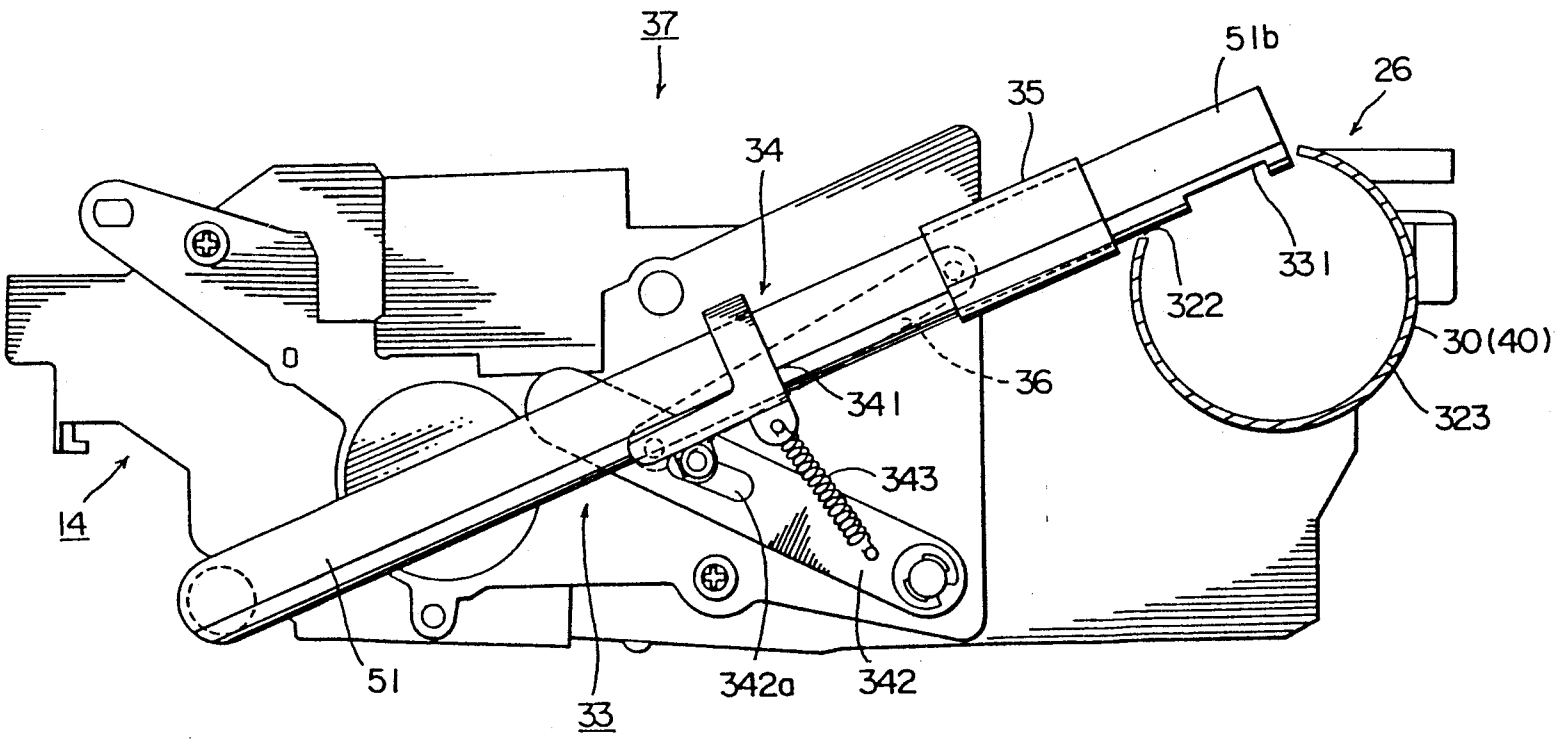
FIGS. 6 A and 6 B are front elevations showing an image forming unit of the copying machine in the mounted or demounted state of recovery toner conveyor means.
Figure 6B:
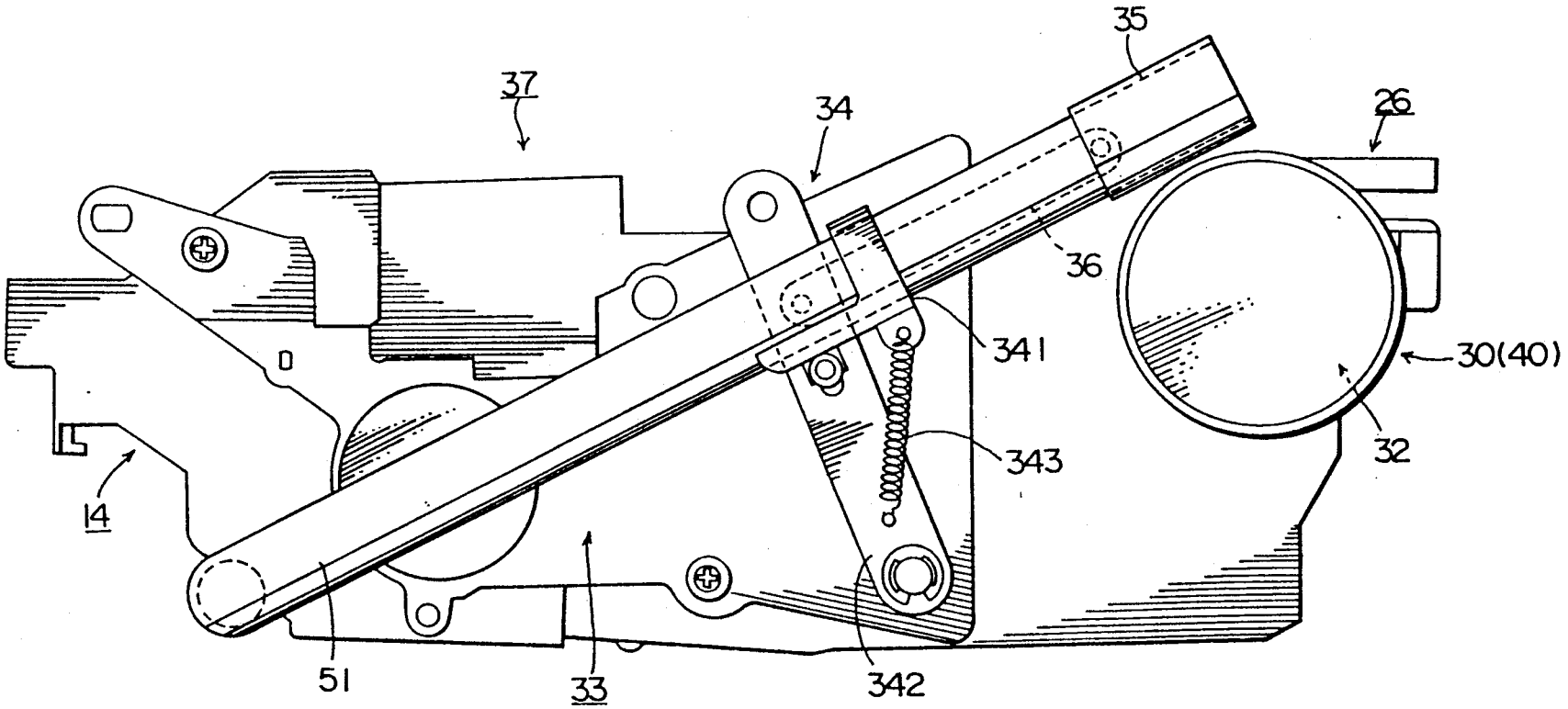

FIGS. 6(A) and 6(B) are front elevations showing an image forming unit 37 of the copying apparatus so as to illustrate the mounted or demounted state of recovery toner conveyor means 33.

The recovery toner conveyor means 33 is for conveying the recovery toner from below the cleaning device 14 to the recovery toner reserving unit 32. The recovery toner conveyor means 33 consists of a hollow cylinder with a not-shown conveyor screw arranged therein, which is rotationally driven by not-shown drive means to convey the recovery toner obliquely upward. The terminal portion of the recovery toner conveyor means 33 at the side of the cleaning device 14 is supported in a rocking manner and is removaly mounted, from above, in the recovery opening 322 of the recovery toner reserving unit 32. Numeral 331 designates a release opening of the recovery toner conveyor means 33. The release opening 331 is opened downward to release the recovery toner from said release opening 331 into the recovery toner reserving unit 32.

Numeral 34 designates a removably mounting lever of the recovery toner conveyor means 33. The removably mounting lever 34 is composed of: a sliding member 341 made slidable in the longitudinal direction on the outer circumference of the cylinder of the recovery toner conveyor means 33; a lever member 342 having its one end portion supported in a rocking manner; and a coil spring 343 mounted under tension between the lever member 342 and the sliding member 341. This sliding member 341 engages with a slot 342*a* which is formed long in the longitudinal direction of the lever member 342 such that it can rotate with respect to said lever member 342 and slide along the slot 342*a*.

Designated at reference numeral 35 is a toner shutter which is associated with the action of the removably mounting lever 34 for opening and closing the release opening 331. The toner shutter 35 is connected to the lever member 342 by a link member 36 so that it coacts with the rocking motions of the lever member 342.

When the removably mounting lever 34 is turned counter-clockwise, as shown in FIG. 6 A, the recovery toner conveyor means 33 comes into its mounted state. The toner shutter 35 is pulled through the link member 36 by the lever member 342 so that it is moved to expose the release opening 331 to the outside. The recovery toner conveyor means 33 comes at its portion close to the release opening 331 into contact with the recovery opening 322 of the recovery toner reserving unit so that it allows the recovery.

When the removably mounting lever 34 is turned clockwise, as shown in FIG. 6 B, the recovery toner conveyor means 33 comes into its demounted state. The toner shutter 35 is pushed through the link member 36 by the lever member 342 to shield the release opening 331. The portion of the recovery toner conveyor means 33 in the vicinity of the release opening 331 leaves the recovery opening 322 of the recovery toner reserving unit 32 to allow the replacement of the toner reservoir 30.

As has been described hereinbefore, according to the toner reservoir of the present invention, the supply toner container for reserving the toner before use and the recovery toner container are united into the toner reservoir and they can be removed together from the developing device. The recovery toner container never fails to be replaced when the supply toner container is replaced for the toner supply. As a result, the replacement is facilitated, and the trouble of the recovery toner overflow due to the neglected replacement of the recovery toner container can be prevented in advance. Since, moreover, the supply and recovery are simultaneously accomplished, it is unnecessary to detect the fullness. Another effect is that the space otherwise required for mounting the recovery toner container in the vicinity of the cleaning device can be used for another purpose.

Another embodiment of the present invention will be explained with reference to FIGS. 7 to 9.

Figure 7:
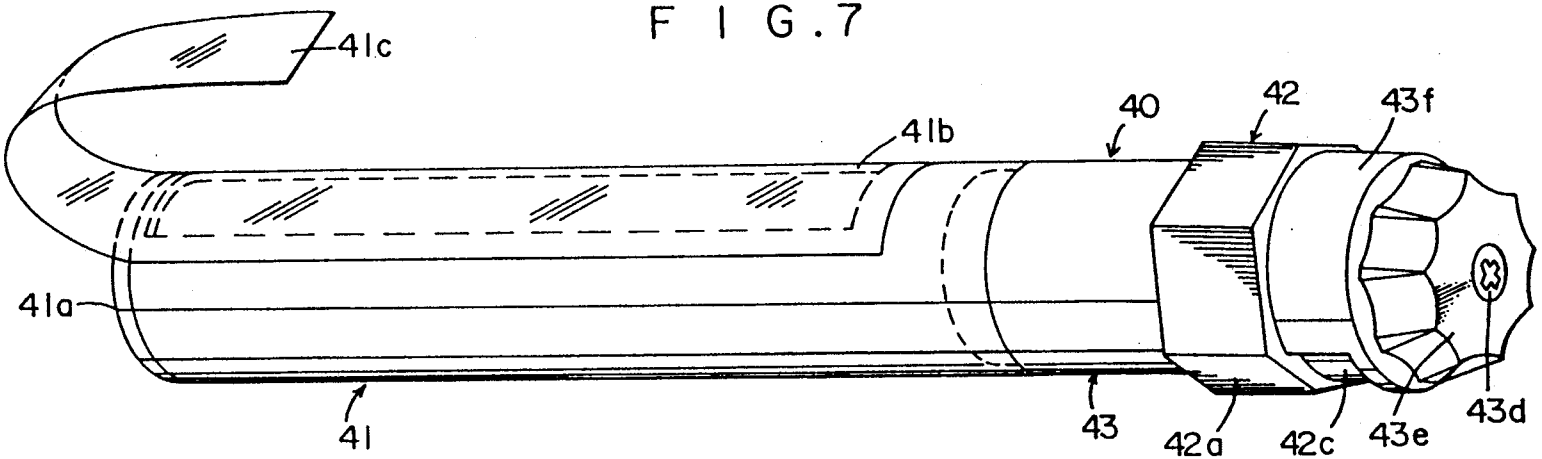
FIG. 7 is a perspective view showing a toner reservoir of another embodiment according to the present invention.
Figure 8:
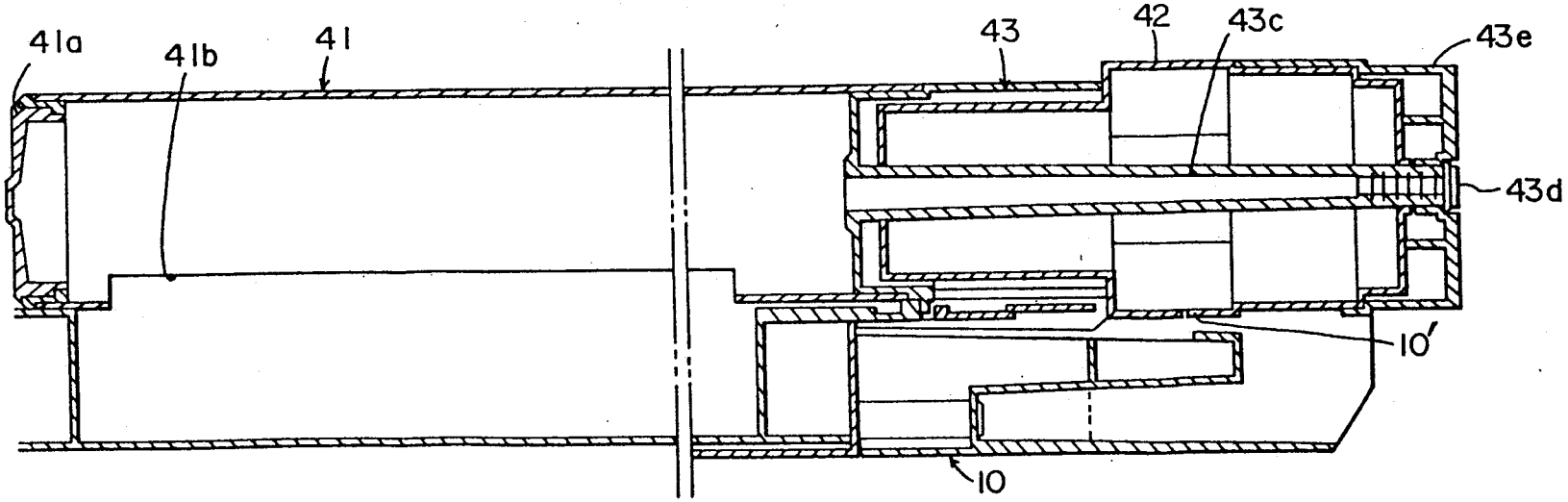
FIG. 8 is a section showing the toner reservoir of FIG. 7 with a developing device.

In this embodiment, a toner reservoir 40 of the present invention has a supply toner reserving unit 41 and a recovery toner reserving unit 42 connected to the supply toner reserving unit 41 by a connecting means 43, as shown in FIGS. 7 and 8.

Figure 9:
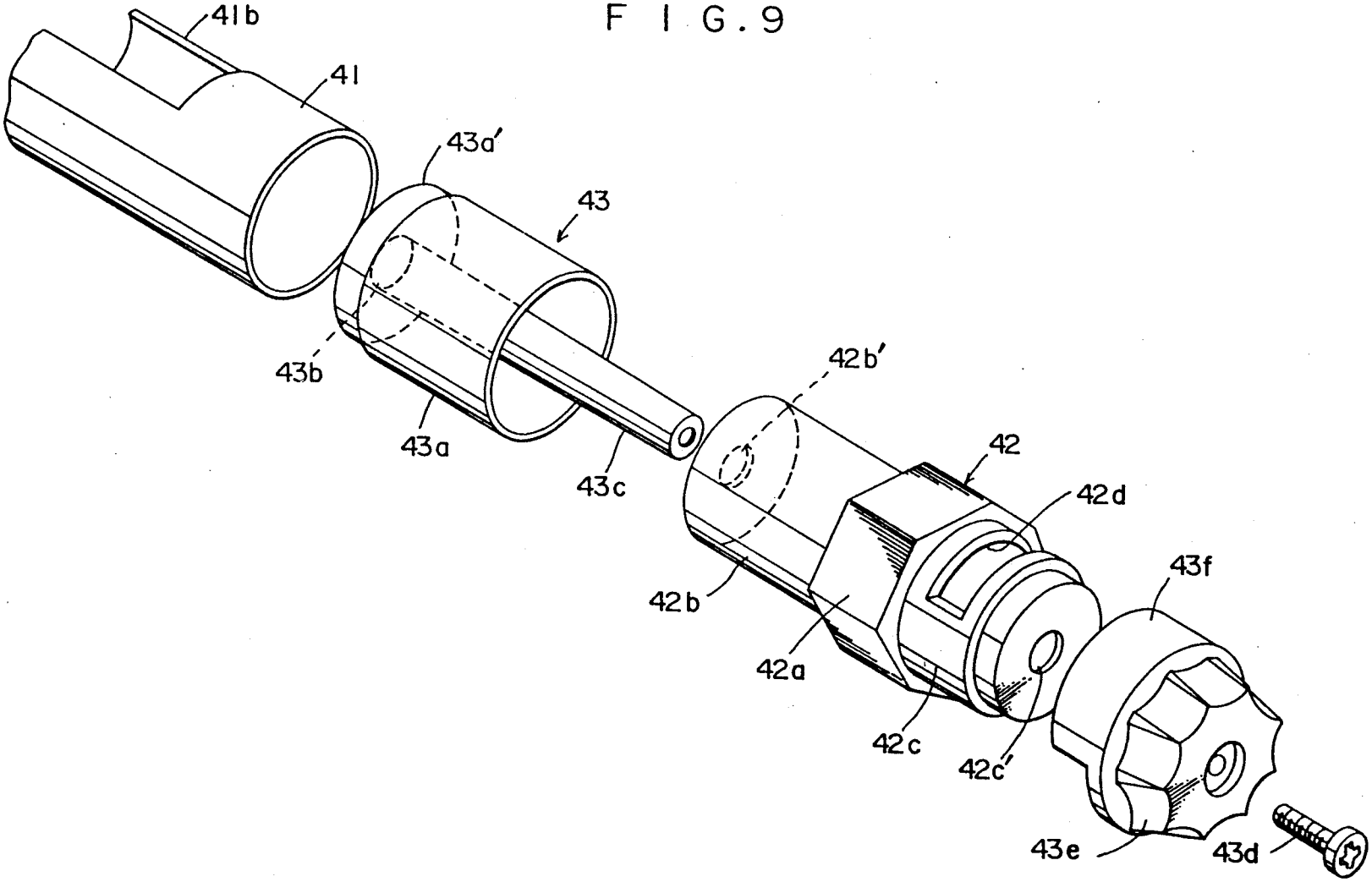
FIG. 9 is an exploded view of the toner reservoir shown in FIG. 7.

The connecting means 43 comprises a cylindrical drum 43*a* having a closed end surface 43*b*, a shaft portion 43*c* extending from the inner central portion of said closed end surface 43*b* beyond an open end surface of said cylindrical drum 43*a*, and a grip member 43*e* fixed to a tip end of said shaft portion 43*c* by a fastening screw 43*d*, as shown in FIG. 9. A shutter 43*f* for shutting a recovery opening 42*d* of said recovery toner reserving unit 42 is provided on said grip member 43*e*.

Said supply toner reserving unit 41 is made of a suitable material such as a paper, and formed in the shape of a cylinder. An inner diameter at one end (right side in FIG. 9) of said supply toner reserving unit 41 is a little larger than an outer diameter of a reduced diameter portion 43*a*' formed on the outside of said closed end surface 43*b* of the cylindrical drum 43*a*, so that said one end of the supply toner reserving unit 41 can be fitted tightly to said reduced diameter portion 43*a*'. The other end (left side in FIG. 9) of said supply toner reserving unit 41 is sealed by a cap member 41*a*. A supply opening 41*b* formed on one side of the wall of said supply toner reserving unit 41 is normally sealed by a flexible seal member 41*c* which is peeled off when toner reserved is to be supplied to the toner hopper 27.

Said recovery toner reserving unit 42 comprises a large diameter portion 42*a* having a non-circular outer peripheral surface, and an inner cylindrical portion 42*b* and an outer cylindrical portion 42*c* arranged at opposite sides of said large diameter portion 42*a*. Through holes 42*b*' and 42*c*' into which said shaft portion 43*c* of said connecting means 43 can be fitted are formed in the center of said inner cylindrical portion 42*b* and outer cylindrical portion 42*c*.

Said shaft portion 43*c* of the connecting means 43 is inserted through said through hole 42*b*' of the inner cylindrical portion 42*b* and said through hole 42*c*' of the outer cylindrical portion 42*c*, so that said inner cylindrical portion 42*b* is loosely fitted into said cylindrical drum 43*a*. The tip end of said shaft portion 43*c* projected from said through hole 42*c*' of the recovery toner reserving unit 42 is connected to said grip member 43*e* through said fastening screw 43*d*, so that said recovery toner reserving unit 42 is united to said supply toner reserving unit 41 through said connecting means 43, as shown in FIG. 8. Accordingly, the supply toner reserving unit 41 can be rotated in the circumferential direction when the grip member 43*e* is rotated in the circumferential direction while maintaining the recovery toner reserving unit 42 in the fixed state with the recovery opening 42*d* thereof facing upwards.

In such a case that the shutter 43*f* connected to the grip member 43*e* and the supply opening 41*b* of the supply toner reserving unit 41 are arranged at the same angular position, when the supply opening 41*b* is faced downwards for supplying toner the shutter 43*f* opens the recovery opening 42*d*, and when the supply opening 41*b* is faced upwards the shutter 43*f* closes the recovery opening 42*d*.

The fixing operation of the recovery toner reserving unit 42 is carried out in such a way that when the toner reservoir 40 of the present invention is set the non-circular outer peripheral surface of the large diameter portion 42*a* is brought into engagement with a projection 10' formed on a front cover of the developing device 10, as shown in FIG. 8.

Figure 10:
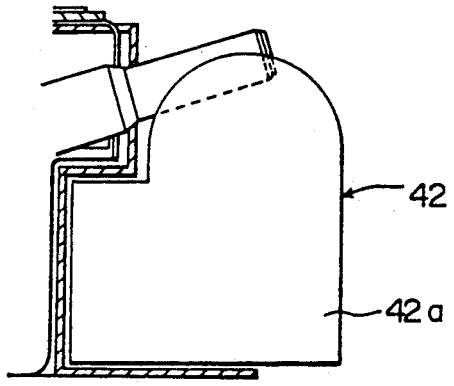
FIG. 10 is a side view of a recovery toner reserving unit of further embodiment according to the present invention.

The outer periphery of said large diameter portion 42*a* of the recovery toner reserving unit 42 is hexagonal, as shown in FIGS. 7 and 9. However, it can be formed in the shape of box with convex upper portion as shown in FIG. 10 which is brought into engagement for fixing with a concave portion of the front cover of the developing device 10.

Figure 11:
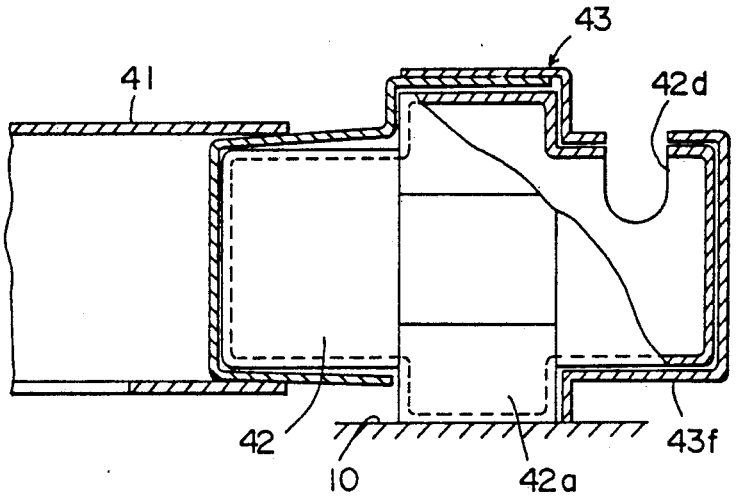
FIG. 11 is a front elevational section showing a toner reservoir of other embodiment according to the present invention.
Figure 12:
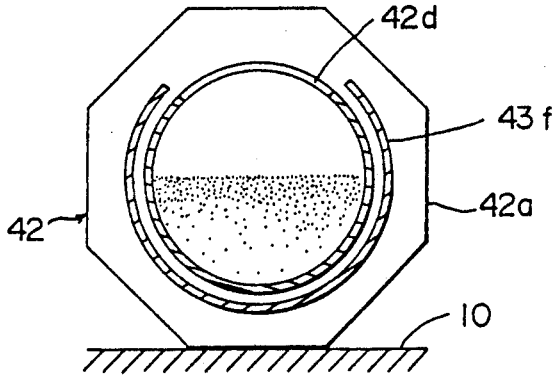
FIG. 12 is a side elevational section of the toner reservoir of FIG. 11.

In the above embodiment, the recovery toner reserving unit 42 is loosely fitted with the shaft portion 43*c* of the connecting means 43 fixed to the supply toner reserving unit 41. However, it can be modified as shown in FIGS. 11 and 12. Specifically, the connecting means 43 is formed so as to cover the outer periphery of the recovery toner reserving unit 42, and the supply toner reserving unit 41 can be rotated in the circumferential direction while maintaining the recovery toner reserving unit 42 being attached and fixed to the front cover of the developing device 10 with the recovery opening 42*d* facing upwards.

In said embodiment, in case that the toner reservoir 40 is set above the toner hopper 27 of the developing device 10, the supply opening 41*b* faced upwards of the supply toner reserving unit 41 is opened fully and then the supply toner reserving unit 41 is installed in the predetermined position. In this state, the recovery opening 42*d* of the recovery toner reserving unit 42 is faced upwards similarly to the above and closed by the shutter 43*f* connected to the grip member 43*e*.

By setting as above, when the grip member 43 is rotated in the circumferential direction the supply toner reserving unit 41 fitted firmly to the cylindrical drum 43*a* connected to the grip member 43*e* is also rotated in the circumferential direction, because the non-circular large diameter portion 42*a* of the recovery toner reserving unit 42 is engaged with the projection 10' of the developing device 10 and fixed. According to the rotation, when the supply opening 41*b* is faced downwards, the toner in the supply toner reserving unit 41 falls into the toner supply unit 26 by its own weight. The toner is then conveyed to a toner supply room by a ladder chain 28 and a proper amount of toner is used continuously for developing.

In case of the replacement of the toner reservoir 40, the lever member 342 is raised as shown in FIG. 6 B, so that a hollow member 51 which is brought into engagement with the recovery opening 42*d* of the recovery toner reserving unit 42 is moved upwards so as to separate from the recovery opening 42*d* and that the release opening 331 provided at the lower surface of a tip end portion 51*b* of said hollow member 51 is closed by the toner shutter 35.

In this state, the recovery opening 42*d* of the recovery toner reserving unit 42 is kept facing upwards, even if the grip member 43*e* is rotated so that the supply opening 41*b* of the supply toner reserving unit 41 is faced upwards. Further, said recovery opening 42*d* is closed perfectly by the shutter 43*f* integrally formed with the grip member 43*e*, so that no toner is scattered from the supply opening or the recovery opening even if the toner reservoir 40 is withdrawn in this state.

According to this embodiment, there is no problem of the toner to be scattered when the toner reservoir is replaced, because the recovery opening is always faced upwards.

What is claimed is:

1. A toner cartridge comprising a supply toner reservoir having a supply opening therein, a recovery toner reservoir having a recovery opening therein, and a connecting means between said reservoirs for connecting said reservoirs, said connecting means permitting, said supply toner reservoir to rotate about its axis relative to said recovery toner reservoir, wherein said recovery opening faces upward while said supply opening is rotated so that it faces downward.

2. The cartridge of claim 1, wherein said supply opening is provided with a removable flexible seal.

3. The cartridge of claim 3 comprising a large diameter portion of said recovery toner reservoir, said portion being of greater diameter than any other component of said cartridge.

4. The cartridge of claim 3 wherein said large diameter portion is non circular.

5. The cartridge of claim 4 wherein said large diameter portion is hexagonal.

6. The cartridge of claim 1 wherein said connecting means is a hollow drum having a closed end adjacent said supply toner reservoir, a shaft fixed to said closed end extending axially toward and through said recovery toner reservoir and attached to a grip member, said supply toner reservoir, said hollow drum, said shaft, and said grip adapted to rotate as a unit.

7. The cartridge of claim 6 wherein said grip is adjacent said recovery toner reservoir in a direction away from said drum.

8. The cartridge of claim 6 wherein said grip is fixed to said shaft by a screw.

9. The cartridge of claim 7 further comprising a shutter on said grip extending axially toward said recovery toner reservoir and extending only partly circumferentially around said recovery toner reservoir said shutter being in the same angular position as said supply opening whereby, when said grip is rotated to cause said supply opening to face downwardly, said shutter does not cover said recovery opening, and when said grip is rotated to cause said supply opening to face upwardly, said shutter covers said recovery opening.

* * * * *